US010001146B2

(12) United States Patent
Joung et al.

(10) Patent No.: US 10,001,146 B2
(45) Date of Patent: Jun. 19, 2018

(54) FLOW CONTROL DEVICE AND FLOW CONTROL METHOD FOR CONSTRUCTION MACHINE

(71) Applicant: VOLVO CONSTRUCTION EQUIPMENT AB, Eskilstuna (SE)

(72) Inventors: Hea-Gyoon Joung, Busan (KR); Sung-Gon Kim, Changwon-si (KR)

(73) Assignee: VOLVO CONSTRUCTION EQUIPMENT AB (SE)

( * ) Notice: Subject to any disclaimer, the term of this patent is extended or adjusted under 35 U.S.C. 154(b) by 360 days.

(21) Appl. No.: 14/760,626

(22) PCT Filed: Jan. 18, 2013

(86) PCT No.: PCT/KR2013/000433

§ 371 (c)(1),
(2) Date: Jul. 13, 2015

(87) PCT Pub. No.: WO2014/112668

PCT Pub. Date: Jul. 24, 2014

(65) Prior Publication Data

US 2015/0361995 A1 Dec. 17, 2015

(51) Int. Cl.
*F15B 11/024* (2006.01)
*F15B 13/02* (2006.01)
*E02F 9/22* (2006.01)

(52) U.S. Cl.
CPC ..... *F15B 11/024* (2013.01); *E02F 9/2217* (2013.01); *E02F 9/2225* (2013.01);
(Continued)

(58) Field of Classification Search
CPC ... E02F 9/22; E02F 9/20; E02F 9/2217; E02F 9/2225; E02F 9/2228; E02F 9/2282
(Continued)

(56) References Cited

U.S. PATENT DOCUMENTS 5,065,664 A * 11/1991 Ohta ..... F15B 11/024 60/474
5,460,001 A * 10/1995 Kato ..... E02F 9/2232 60/426

(Continued)

FOREIGN PATENT DOCUMENTS

CN 1914384 A 2/2007
CN 102022612 A 4/2011

(Continued)

OTHER PUBLICATIONS

International Search Report (in English and Korean) and Written Opinion of the International Searching Authority (in Korean) for PCT/KR2013/000433, dated Jul. 3, 2013; ISA/KR.

(Continued)

*Primary Examiner* — Michael Leslie
*Assistant Examiner* — Richard Drake
(74) *Attorney, Agent, or Firm* — Harness, Dickey & Pierce, P.L.C.

(57) ABSTRACT

A flow control device for a construction machine including a first hydraulic cylinder and a second hydraulic cylinder connected to a hydraulic pump, which is connected to an engine. A first control valve and a second control valve are also included. A regeneration flow path is configured to supplement and reuse hydraulic fluid that returns to a hydraulic tank during a retractable drive of the first hydraulic cylinder. A regeneration valve is installed in the regeneration flow path. A pressure compensation type flow control valve is installed in a meter-in flow path of a spool of the first control valve, and is configured to limit the flow rate of the hydraulic fluid supplied from the hydraulic pump to the first hydraulic cylinder during a combined operation of the first and second hydraulic cylinders.

4 Claims, 4 Drawing Sheets

(52) U.S. Cl.
CPC ..... *E02F 9/2228* (2013.01); *E02F 9/2282* (2013.01); *E02F 9/2296* (2013.01); *F15B 13/026* (2013.01); *F15B 13/027* (2013.01); *F15B 2211/20546* (2013.01); *F15B 2211/3133* (2013.01); *F15B 2211/505* (2013.01)

(58) Field of Classification Search
USPC ..... 60/420, 421
See application file for complete search history.

(56) References Cited

U.S. PATENT DOCUMENTS

| | | | | |
|---|---|---|---|---|
| 5,791,226 | A * | 8/1998 | Chung | F15B 11/024 91/29 |
| 6,050,090 | A * | 4/2000 | Tohji | E02F 9/2203 60/421 |
| 6,976,358 | B2 * | 12/2005 | Kim | E02F 9/2221 60/450 |
| 7,562,615 | B2 * | 7/2009 | Abe | E02F 9/2203 91/436 |
| 8,336,443 | B2 * | 12/2012 | Abe | E02F 9/2203 91/436 |
| 9,194,382 | B2 * | 11/2015 | Shin | E02F 9/2235 |
| 2009/0308068 | A1 | 12/2009 | Yoshino | |
| 2011/0158830 | A1 | 6/2011 | Cheong | |
| 2013/0098021 | A1 | 4/2013 | Shin et al. | |
| 2013/0103270 | A1 | 4/2013 | Joung et al. | |
| 2013/0121852 | A1 | 5/2013 | Joung et al. | |
| 2013/0160439 | A1 | 6/2013 | Lee et al. | |
| 2013/0228245 | A1 | 9/2013 | Ku et al. | |
| 2014/0010688 | A1 | 1/2014 | Kim et al. | |
| 2014/0238010 | A1 | 8/2014 | Joung et al. | |
| 2014/0325975 | A1 | 11/2014 | Kim et al. | |

FOREIGN PATENT DOCUMENTS

| | | | | |
|---|---|---|---|---|
| CN | 102686809 | A | 9/2012 | |
| CN | 103597218 | A | 2/2014 | |
| JP | H10-311305 | A | 11/1998 | |
| KR | 10-2006-0112340 | A | 11/2006 | |
| KR | 10-2006-0120584 | A | 11/2006 | |
| KR | 20060112340 | A | 11/2006 | |
| KR | 10-2010-0044941 | A | 5/2010 | |
| KR | 10-2011-0076073 | A | 7/2011 | |
| WO | WO 2011162429 | A1 * | 12/2011 | E02F 9/2235 |

OTHER PUBLICATIONS

Office Action issued by the Canadian Intellectual Property Office (CIPO) dated Aug. 29, 2016 for corresponding CA Application No. 2,897,003 (4 pages).

First Office Action issued by the State Intellectual Property Office (SIPO) dated May 30, 2016 concerning the corresponding China patent Application No. 201380070774.5 (with English translation). (19 pages).

* cited by examiner

FLOW CONTROL DEVICE AND FLOW CONTROL METHOD FOR CONSTRUCTION MACHINE

TECHNICAL FIELD

The present invention relates to a control apparatus and method for a construction machine. More particularly, the present invention relates to such a control apparatus and method for a construction machine in which when a combined operation of a boom and an arm of an excavator is performed, a loss in the flow rate of the hydraulic fluid discharged from the hydraulic pump can be prevented from occurring.

BACKGROUND OF THE INVENTION

A conventional flow control apparatus for a construction machine in accordance with the prior art as shown in FIG. 1 includes:

an engine 1;

a variable displacement hydraulic pump (hereinafter, referred to as "hydraulic pump") 2 connected to the engine 1;

a first hydraulic cylinder 3 and a second hydraulic cylinder 4, which are connected to the hydraulic pump 2;

a first control valve 6 installed in a center bypass path 5 of the hydraulic pump 2, the first control valve being configured to allow hydraulic fluid discharged from the hydraulic pump 2 to be returned to a hydraulic tank T in its neutral state and configured to control a start, a stop, and a direction change of the first hydraulic cylinder 3 in its shifted state;

a second control valve 7 installed on a downstream side of the center bypass path 5 of the hydraulic pump 2, the second control valve being configured to allow the hydraulic fluid discharged from the hydraulic pump 2 to be returned to the hydraulic tank T in its neutral state and configured to control a start, a stop, and a direction change of the second hydraulic cylinder 4 in its shifted state; and a regeneration flow path 10 configured to supplement and reuse the hydraulic fluid that returns to the hydraulic tank T from a large chamber of the first hydraulic cylinder 3 during a retractable drive of the first hydraulic cylinder 3 due to an attachment (including a boom, an arm, or a bucket)'s own weight, and a regeneration valve 13 installed in the regeneration flow path 10.

As shown in FIG. 1, when a spool of the first control valve 6 is shifted to the right on the drawing sheet by a pilot signal pressure from a pilot pump (not shown) through the manipulation of a manipulation lever (not shown), hydraulic fluid discharged from the hydraulic pump 2 is supplied to a small chamber of the first hydraulic cylinder 3 via a meter-in flow path 12 of the first control valve 6. In this case, hydraulic fluid discharged from a large chamber of the first hydraulic cylinder 3 is returned to the hydraulic tank T via the first control valve 6 and the return flow path 11. Thus, the first hydraulic cylinder 3 is driven to be retracted so that the boom can be driven to perform a boom-down operation.

In addition, when the spool of the first control valve 6 is shifted to the left on the drawing sheet through the manipulation of a manipulation lever (not shown), hydraulic fluid discharged from the hydraulic pump 2 is supplied to the large chamber of the first hydraulic cylinder 3 via the first control valve 6. In this case, hydraulic fluid discharged from the small chamber of the first hydraulic cylinder 3 is returned to the hydraulic tank T via the first control valve 6 and the return flow path 11*a*. Thus, the first hydraulic cylinder 3 is driven to be extended so that the boom can be driven to perform a boom-up operation.

Meanwhile, when the hydraulic fluid from the large chamber of the first hydraulic cylinder 3 is returned to the hydraulic tank T due to the retractable drive of the first hydraulic cylinder 3, a back pressure is formed in the regeneration flow path 10 by a back pressure check valve 18 installed in the return flow path 11. For this reason, when a pressure within the small chamber of the first hydraulic cylinder 3 is low, the hydraulic fluid returned from the large chamber of the first hydraulic cylinder 3 to the hydraulic tank T can be supplementarily supplied to the small chamber of the first hydraulic cylinder 3 through the regeneration flow path 10.

In other words, when there is a shortage in the hydraulic fluid supplied to the small chamber during the retractable drive of the first hydraulic cylinder 3, the hydraulic fluid returned from the large chamber of the first hydraulic cylinder 3 to the hydraulic tank T can be recycled and supplementarily supplied to the small of the first hydraulic cylinder 3 through the regeneration flow path 10.

In the meantime, when a combined operation of a boom and an arm is performed by a user, i.e., when the first hydraulic cylinder 3 is driven to be retracted to perform the boom-down operation of the boom and the second hydraulic cylinder 4 is driven to be retracted to perform the arm-out operation of the arm, a load pressure generated in the second hydraulic cylinder 4 is relatively higher than that generated in the first hydraulic cylinder 3. In this case, the hydraulic fluid discharged from the hydraulic pump 2 is much more supplied to the first hydraulic cylinder 3 whose load pressure is relatively low through the meter-in flow path 12 in terms of the characteristics of the hydraulic fluid.

In other words, the conventional flow control apparatus entails a problem in that since the hydraulic fluid discharged from the hydraulic pump 2 is much more supplied to the first hydraulic cylinder 3 through the meter-in flow path 12, the efficiency of the recycled hydraulic fluid is degraded. Besides, there is a problem in that the hydraulic fluid from the hydraulic pump 2 is introduced into the small chamber of the first hydraulic cylinder 3, which causes a loss of the hydraulic fluid, thus leading to a decrease in the energy efficiency of the machine.

SUMMARY OF THE INVENTION

Accordingly, the present invention has been made to solve the aforementioned problems occurring in the prior art, and it is an object of the present invention to provide a flow control apparatus and method for a construction machine, which can limit the flow rate of the hydraulic fluid supplied from the hydraulic pump to a boom cylinder whose load pressure is relatively low during a combined operation of a boom and an arm so that an unnecessary loss of the hydraulic fluid can be prevented.

Technical Solution

To achieve the above object, in accordance with an embodiment of the present invention, there is provided a flow control apparatus for a construction machine, including:

an engine;

a variable displacement hydraulic pump connected to the engine;

a first hydraulic cylinder and a second hydraulic cylinder, which are connected to the hydraulic pump;

a first control valve installed in a center bypass path of the hydraulic pump, the first control valve being configured to allow hydraulic fluid discharged from the hydraulic pump to be returned to a hydraulic tank in its neutral state and configured to control a start, a stop, and a direction change of the first hydraulic cylinder in its shifted state;

a second control valve installed on a downstream side of the center bypass path of the hydraulic pump, the second control valve being configured to allow the hydraulic fluid discharged from the hydraulic pump to be returned to the hydraulic tank in its neutral state and configured to control a start, a stop, and a direction change of the second hydraulic cylinder in its shifted state;

a regeneration flow path configured to supplement and reuse the hydraulic fluid that returns to the hydraulic tank during a retractable drive of the first hydraulic cylinder, and a regeneration valve installed in the regeneration flow path; and a pressure compensation type flow control valve installed in a meter-in flow path of a spool of the first control valve and configured to limit the flow rate of the hydraulic fluid supplied from the hydraulic pump to the first hydraulic cylinder during a combined operation of the first and second hydraulic cylinders.

The pressure compensation type flow control valve may include a spool having a first position in which the meter-in flow path is opened by a pressure passing through a meter-in orifice installed in the meter-in flow path and an elastic force of a valve spring, and a second position in which the meter-in flow path is closed when the spool is shifted by a pressure in the meter-in flow path.

The pressure compensation type flow control valve may include a spool having a first position in which the meter-in flow path is opened by a pressure passing through a meter-in orifice installed in the meter-in flow path and an elastic force of a valve spring, and a second position in which the flow rate of the hydraulic fluid is limited through the shift of the spool in a direction in which an opening portion of the meter-in orifice is reduced if the pressure in the meter-in flow path is higher than the elastic force of the valve spring.

The first hydraulic cylinder 3 may be a boom cylinder, and the second hydraulic cylinder 4 may be an arm cylinder.

To achieve the above object, in accordance with another embodiment of the present invention, there is provided a flow control apparatus for a construction machine, including:

an engine;

a variable displacement hydraulic pump connected to the engine;

a first hydraulic cylinder and a second hydraulic cylinder, which are connected to the hydraulic pump;

a first control valve installed in a center bypass path of the hydraulic pump, the first control valve being configured to allow hydraulic fluid discharged from the hydraulic pump to be returned to a hydraulic tank in its neutral state and configured to control a start, a stop, and a direction change of the first hydraulic cylinder in its shifted state;

a second control valve installed on a downstream side of the center bypass path of the hydraulic pump, the second control valve being configured to allow the hydraulic fluid discharged from the hydraulic pump to be returned to the hydraulic tank in its neutral state and configured to control a start, a stop, and a direction change of the second hydraulic cylinder in its shifted state;

a regeneration flow path configured to supplement and reuse the hydraulic fluid that returns to the hydraulic tank during a retractable drive of the first hydraulic cylinder, and a regeneration valve installed in the regeneration flow path;

a pressure compensation type flow control valve installed in a meter-in flow path of a spool of the first control valve and configured to limit the flow rate of the hydraulic fluid supplied from the hydraulic pump to the first hydraulic cylinder during a combined operation of the first and second hydraulic cylinders;

at least one pressure detection sensor configured to detect a pilot pressure that is input to the first and second control valves to shift the first and second control valves;

a controller configured to calculate a required flow rate of hydraulic fluid, which corresponds to the pressure detected by the pressure detection sensor and output a control signal that corresponds to the calculated required flow rate; and an electronic proportional valve configured to output, as a control signal, a secondary pressure generated therefrom to correspond to the control signal applied thereto from the controller, to a pump regulator that controls a flow rate of the hydraulic fluid discharged from the hydraulic pump.

To achieve the above object, in accordance with still another embodiment of the present invention, there is provided a flow control method for a construction machine which includes:

a variable displacement hydraulic pump connected to an engine;

a first hydraulic cylinder and a second hydraulic cylinder, which are connected to the hydraulic pump;

a first control valve installed in a center bypass path of the hydraulic pump and configured to control a start, a stop, and a direction change of the first hydraulic cylinder in its shifted state;

a second control valve installed on a downstream side of the center bypass path of the hydraulic pump and configured to control a start, a stop, and a direction change of the second hydraulic cylinder in its shifted state;

a regeneration flow path configured to reuse the hydraulic fluid that returns to a hydraulic tank by an attachment's own weight and a regeneration valve;

a pressure compensation type flow control valve installed in a meter-in flow path of a spool of the first control valve and configured to limit the flow rate of the hydraulic fluid supplied from the hydraulic pump to the first hydraulic cylinder during a combined operation of the first and second hydraulic cylinders;

at least one pressure detection sensor configured to detect a pilot pressure that is input to the first and second control valves to shift the first and second control valves;

a controller configured to calculate a required flow rate of hydraulic fluid, which corresponds to the pressure detected by the pressure detection sensor and output a control signal that corresponds to the calculated required flow rate;

an electronic proportional valve configured to output, as a control signal, a secondary pressure generated therefrom to correspond to the control signal applied thereto from the controller, to a pump regulator that controls a flow rate of the hydraulic fluid discharged from the hydraulic pump, the flow control method including:

a first step of allowing the pressure detection sensor to detect the pilot pressure that is input to the first and second control valves to shift the first and second control valves through a manipulation of a manipulation lever;

a second step of calculating the required flow rate of the hydraulic fluid, which corresponds to the detected manipulation amount of the manipulation lever; and a third step of outputting an electrical control signal that corresponds to the calculated required flow rate to the electronic proportional valve, wherein the flow rate of the hydraulic fluid supplied from the hydraulic pump to the first and second hydraulic cylinders by the shifting of the first and second control valves is set to be equal to or lower than the flow rate of the hydraulic fluid passing through the pressure compensation type flow control valve.

Advantageous Effect

The flow control apparatus and method for a construction machine in accordance with the present invention as constructed above has the following advantages.

The flow control apparatus and method can limit the flow rate of the hydraulic fluid supplied from the hydraulic pump to the boom cylinder whose load pressure is relatively low during a combined operation of the boom and the arm so that an unnecessary loss of the hydraulic fluid can be prevented, thereby increasing the energy efficiency and thus the fuel efficiency.

BRIEF DESCRIPTION OF THE DRAWINGS

The above objects, other features and advantages of the present invention will become more apparent by describing the preferred embodiments thereof with reference to the accompanying drawings, in which.

EXPLANATION ON REFERENCE NUMERALS OF MAIN ELEMENTS IN THE DRAWINGS

Figure 1:
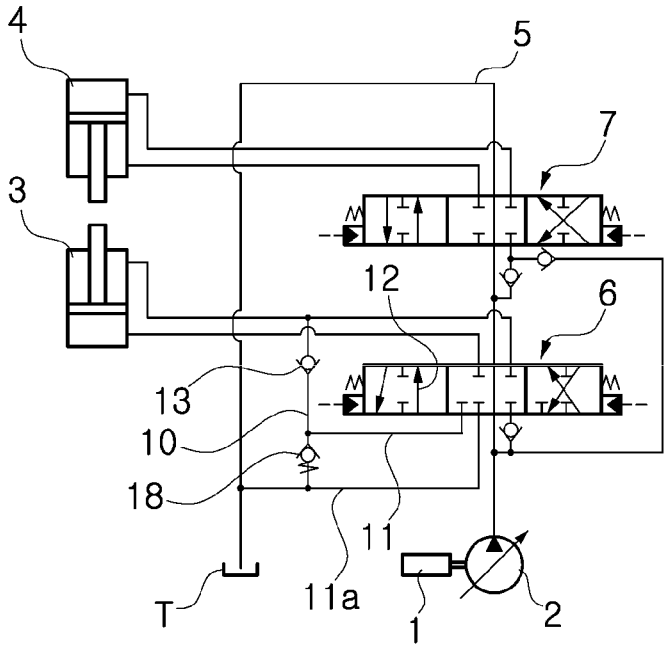
FIG. 1 is a hydraulic circuit diagram showing a flow control apparatus for a construction machine in accordance with the prior art.

1: engine
2: variable displacement hydraulic pump
3: first hydraulic cylinder
4: second hydraulic cylinder
5: center bypass path
6: first control valve
7: second control valve
8: first manipulation lever
9: second manipulation lever
10: regeneration flow path
11, 11*a*: return flow path
12: meter-in flow path
13: regeneration valve
14: pressure compensation type flow control valve
15: valve spring
16: meter-in orifice
17: spool

DETAILED DESCRIPTION OF THE INVENTION

Now, a flow control apparatus for a construction machine in accordance with a preferred embodiment of the present invention will be described in detail with reference to the accompanying drawings. The matters defined in the description, such as the detailed construction and elements, are nothing but specific details provided to assist those of ordinary skill in the art in a comprehensive understanding of the invention, and the present invention is not limited to the embodiments disclosed hereinafter.

In order to definitely describe the present invention, a portion having no relevant to the description will be omitted, and through the specification, like elements are designated by like reference numerals.

In the specification and the claims, when a portion includes an element, it is meant to include other elements, but not exclude the other elements unless otherwise specifically stated herein.

Figure 2:
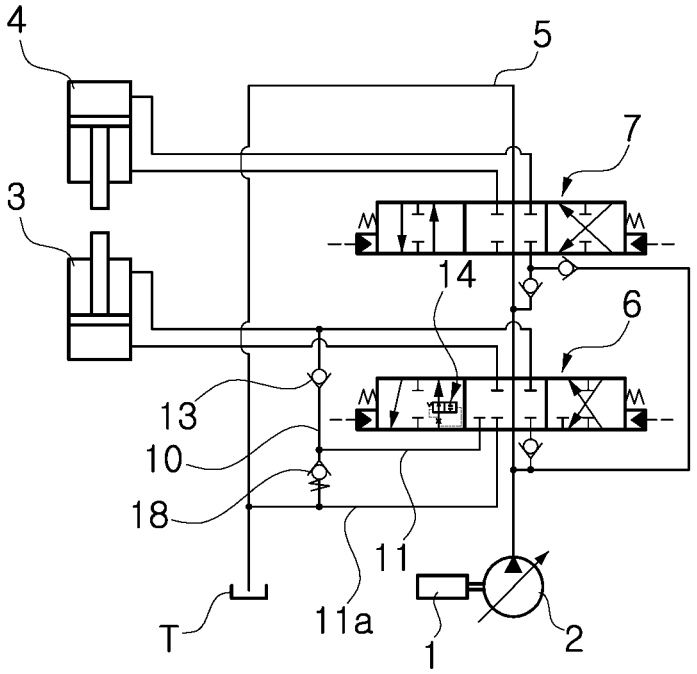
Prior Art Fig. 2
FIG. 2 is a hydraulic circuit diagram showing a flow control apparatus for a construction machine in accordance with a preferred embodiment of the present invention.
Figure 3:
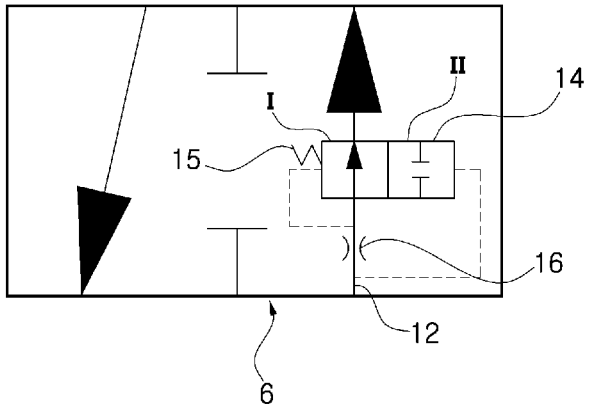
FIG. 3 is an enlarged view showing a pressure compensation type flow control valve shown in FIG. 2.
Figure 4:
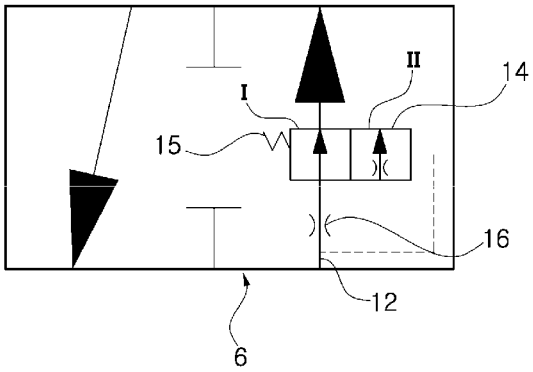
FIG. 4 is an exemplary view showing a modification of a pressure compensation type flow control valve shown in FIG. 2.
Figure 5:
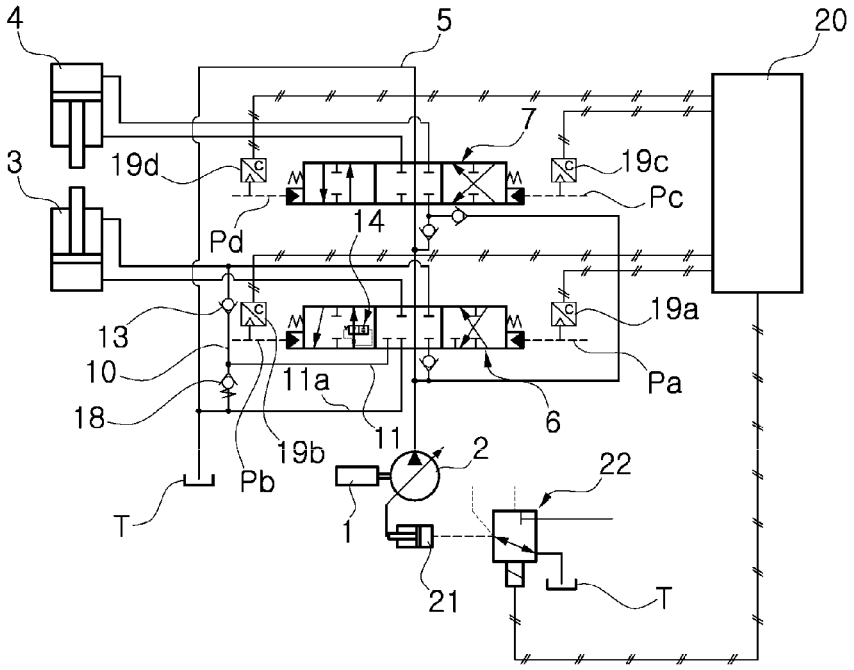
FIG. 5 is a hydraulic circuit diagram showing a flow control apparatus for a construction machine in accordance with another preferred embodiment of the present invention.
Figure 6:
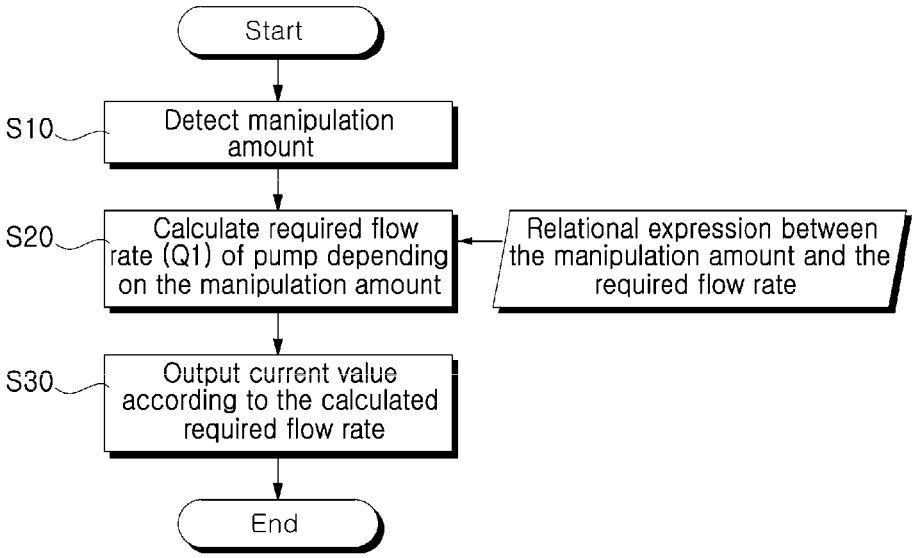
FIG. 6 is a flowchart showing a process for controlling the flow rate of the hydraulic fluid from the hydraulic pump in a hydraulic circuit diagram of a flow control apparatus for a construction machine in accordance with another preferred embodiment of the present invention.
Figure 7:
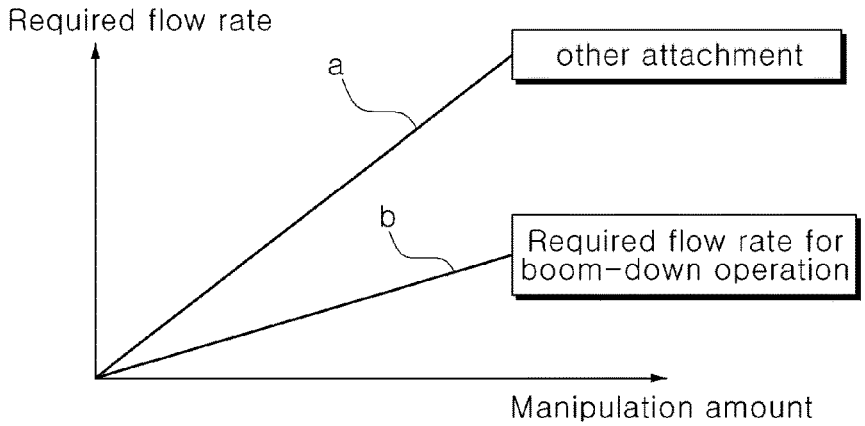
FIG. 7 is a graph showing the relationship between a manipulation amount and a required flow rate of hydraulic fluid in a hydraulic circuit diagram of a flow control apparatus for a construction machine in accordance with a preferred embodiment of the present invention.

FIG. 2 is a hydraulic circuit diagram showing a flow control apparatus for a construction machine in accordance with a preferred embodiment of the present invention, FIG. 3 is an enlarged view showing a pressure compensation type flow control valve shown in FIG. 2, FIG. 4 is an exemplary view showing a modification of a pressure compensation type flow control valve shown in FIG. 2, FIG. 5 is a hydraulic circuit diagram showing a flow control apparatus for a construction machine in accordance with another preferred embodiment of the present invention, FIG. 6 is a flowchart showing a process for controlling the flow rate of the hydraulic fluid from the hydraulic pump in a hydraulic circuit diagram of a flow control apparatus for a construction machine in accordance with another preferred embodiment of the present invention, and FIG. 7 is a graph showing the relationship between a manipulation amount and a required flow rate of hydraulic fluid in a hydraulic circuit diagram of a flow control apparatus for a construction machine in accordance with a preferred embodiment of the present invention.

Referring to FIGS. 2 to 4, the flow control apparatus for a construction machine in accordance with an embodiment of the present invention includes:

an engine 1;

a variable displacement hydraulic pump (hereinafter, referred to as "hydraulic pump") 2 connected to the engine 1;

a first hydraulic cylinder 3 and a second hydraulic cylinder 4, which are connected to the hydraulic pump 2;

a first control valve 6 installed in a center bypass path 5 of the hydraulic pump 2, the first control valve being configured to allow hydraulic fluid discharged from the hydraulic pump 2 to be returned to a hydraulic tank T in its neutral state and configured to control a start, a stop, and a direction change of the first hydraulic cylinder 3 in its shifted state;

a second control valve 7 installed on a downstream side of the center bypass path 5 of the hydraulic pump 2, the second control valve being configured to allow the hydraulic fluid discharged from the hydraulic pump 2 to be returned to the hydraulic tank T in its neutral state and configured to control a start, a stop, and a direction change of the second hydraulic cylinder 4 in its shifted state;

a regeneration flow path 10 configured to supplement and reuse the hydraulic fluid that returns to the hydraulic tank T from a large chamber of the first hydraulic cylinder 3 during a retractable drive of the first hydraulic cylinder 3 due to an attachment (including a boom, an arm, or a bucket)'s own weight, and a regeneration valve 13 installed in the regeneration flow path 10; and a pressure compensation type flow control valve 14 installed in a meter-in flow path 12 of a spool of the first control valve 6 and configured to limit the flow rate of the hydraulic fluid supplied from the hydraulic pump 2 to the first hydraulic cylinder 3 during a combined operation of the first and second hydraulic cylinders 3 and 4.

The pressure compensation type flow control valve 14 includes a spool having a first position I in which the meter-in flow path is opened by a pressure passing through a meter-in orifice 16 installed in the meter-in flow path 12 and an elastic force of a valve spring 15, and a second position II in which the meter-in flow path 12 is closed when the spool is shifted by a pressure in the meter-in flow path 12.

The pressure compensation type flow control valve 14 includes a spool having a first position I in which the meter-in flow path 12 is opened by a pressure passing through a meter-in orifice 16 installed in the meter-in flow path 12 and an elastic force of a valve spring, and a second position II in which the flow rate of the hydraulic fluid is limited through the shift of the spool in a direction in which an opening portion of the meter-in orifice 16 is reduced if the pressure in the meter-in flow path 12 is higher than the elastic force of the valve spring 15.

The first hydraulic cylinder 3 is a boom cylinder, and the second hydraulic cylinder 4 is an arm cylinder.

In this case, a configuration of the flow control apparatus for a construction machine in accordance with an embodiment of the present invention is the same as that of the conventional flow control apparatus for a construction machine as shown in FIG. 1, except the pressure compensation type flow control valve 14 installed in the meter-in flow path 12 in order to limit the supply of a relatively large amount of the hydraulic fluid from the hydraulic pump 2 to the first hydraulic cylinder 3 during a combined operation of the first and second hydraulic cylinders 3 and 4. Thus, the detailed description of the same configuration and operation thereof will be omitted to avoid redundancy, and the same hydraulic parts are denoted by the same reference numerals.

In accordance with the configuration as described above, when a spool of the first control valve 6 is shifted to the right on the drawing sheet by a pilot signal pressure from a pilot pump (not shown) through the manipulation of a manipulation lever, hydraulic fluid discharged from the hydraulic pump 2 is supplied in a limited amount to a small chamber of the first hydraulic cylinder 3 by a pressure compensation type flow control valve 14 installed in a meter-in flow path 12 of the first control valve 6. In this case, hydraulic fluid discharged from a large chamber of the first hydraulic cylinder 3 is returned to the hydraulic tank T via the first control valve 6, the return flow path 11 and the back pressure check valve 18. Thus, the first hydraulic cylinder 3 is driven to be refracted so that the boom can be driven to perform a boom-down operation.

Meanwhile, when the hydraulic fluid discharged from the large chamber of the first hydraulic cylinder 3 is returned to the hydraulic tank T due to the retractable drive of the first hydraulic cylinder 3, a back pressure is formed in the regeneration flow path 10 by the back pressure check valve 18 installed in the return flow path 11. For this reason, when a pressure within the small chamber of the first hydraulic cylinder 3 is low, the hydraulic fluid returned from the large chamber of the first hydraulic cylinder 3 to the hydraulic tank T can be supplementarily supplied to the small chamber of the first hydraulic cylinder 3 through the regeneration flow path 10.

In the meantime, when a combined operation of a boom and an arm is performed by a user, i.e., when the first hydraulic cylinder 3 generating a relatively lower pressure is driven to be retracted to perform the boom-down operation of the boom and the second hydraulic cylinder 4 generating a relatively high load pressure is driven to be retracted to perform the arm-out operation of the arm, the supply of the hydraulic fluid from the hydraulic pump 2 to the small chamber of the first hydraulic cylinder 3 is limited by the pressure compensation type flow control valve 14 installed in the meter-in flow path 12. Thus, the hydraulic fluid discharged from the hydraulic pump 2 is supplied in a reduced amount to the first hydraulic cylinder 3 after passing through the pressure compensation type flow control valve 14 installed in the meter-in flow path 12 (indicated by a line "b" in the graph of the FIG. 7), and the remaining hydraulic fluid discharged from the hydraulic pump 2 is supplied to the second hydraulic cylinder 4 (indicated by a line "a" in the graph of the FIG. 7).

For this reason, even during a combined operation in which the boom-down operation of the boom is performed by the retractable drive of the first hydraulic cylinder 3 and the arm-out operation of the boom is performed by the retractable drive of the second hydraulic cylinder 4, the hydraulic fluid discharged from the hydraulic pump 2 can be prevented from being much more supplied to the first hydraulic cylinder 3 in which a relatively low load pressure is generated than in the second hydraulic cylinder 4.

Meanwhile, as in the pressure compensation type flow control valve 14 shown in FIG. 4, if a pressure of the hydraulic fluid which is formed in the meter-in flow path 12 is higher than an elastic force of the valve spring 15, a spool of the pressure compensation type flow control valve 14 is shifted to the left on the drawing sheet. In other words, the spool of the pressure compensation type flow control valve 14 is shifted to the second position II to further reduce an opening portion of the meter-in orifice 16 so that the supply of the hydraulic fluid from the hydraulic pump 2 to the first hydraulic cylinder 3 can be further limited.

Referring to FIG. 5, the flow control apparatus for a construction machine in accordance with another embodiment of the present invention includes:

an engine 1;

a variable displacement hydraulic pump (hereinafter, referred to as "hydraulic pump") 2 connected to the engine 1;

a first hydraulic cylinder 3 and a second hydraulic cylinder 4, which are connected to the hydraulic pump 2;

a first control valve 6 installed in a center bypass path 5 of the hydraulic pump 2, the first control valve being configured to allow hydraulic fluid discharged from the hydraulic pump 2 to be returned to a hydraulic tank T in its neutral state and configured to control a start, a stop, and a direction change of the first hydraulic cylinder 3 in its shifted state;

a second control valve 7 installed on a downstream side of the center bypass path 5 of the hydraulic pump 2, the second control valve being configured to allow the hydraulic fluid discharged from the hydraulic pump 2 to be returned to the hydraulic tank T in its neutral state and configured to control a start, a stop, and a direction change of the second hydraulic cylinder 4 in its shifted state;

a regeneration flow path 10 configured to supplement and reuse the hydraulic fluid that returns to the hydraulic tank T from a large chamber of the first hydraulic cylinder 3 during a retractable drive of the first hydraulic cylinder 3, and a regeneration valve 13 installed in the regeneration flow path 10;

a pressure compensation type flow control valve 14 installed in a meter-in flow path 12 of a spool of the first control valve 6 and configured to limit the flow rate of the hydraulic fluid supplied from the hydraulic pump 2 to the first hydraulic cylinder 3 during a combined operation of the first and second hydraulic cylinders 3 and 4;

at least one pressure detection sensor Pa, Pb, Pc, Pd configured to detect a pilot pressure that is input to the first and second control valves 6 an 7 to shift the first and second control valves 6 and 7;

a controller 20 configured to calculate a required flow rate of hydraulic fluid, which corresponds to the pressure detected by the pressure detection sensor Pa, Pb, Pc, Pd and output a control signal that corresponds to the calculated required flow rate; and an electronic proportional valve 22 configured to output, as a control signal, a secondary pressure generated therefrom to correspond to the control signal applied thereto from the controller 20, to a pump regulator 21 that controls a flow rate of the hydraulic fluid discharged from the hydraulic pump 2.

In accordance with still another embodiment of the present invention, there is provided a flow control method for a construction machine which includes:

a variable displacement hydraulic pump (hereinafter, referred to as "hydraulic pump") 2 connected to an engine 2;

a first hydraulic cylinder 3 and a second hydraulic cylinder 4, which are connected to the hydraulic pump 2;

a first control valve 6 installed in a center bypass path 5 of the hydraulic pump 2 and configured to control a start, a stop, and a direction change of the first hydraulic cylinder 3 in its shifted state;

a second control valve 7 installed on a downstream side of the center bypass path 5 of the hydraulic pump 2 and configured to control a start, a stop, and a direction change of the second hydraulic cylinder 4 in its shifted state;

a regeneration flow path 10 configured to reuse the hydraulic fluid that returns to a hydraulic tank T from the first hydraulic cylinder 3 by an attachment's own weight and a regeneration valve installed in the regeneration flow path 10;

a pressure compensation type flow control valve 14 installed in a meter-in flow path 12 of a spool of the first control valve 6 and configured to limit the flow rate of the hydraulic fluid supplied from the hydraulic pump 2 to the first hydraulic cylinder 3 during a combined operation of the first and second hydraulic cylinders 3 and 4;

at least one pressure detection sensor Pa, Pb, Pc, Pd configured to detect a pilot pressure that is input to the first and second control valves 6 an 7 to shift the first and second control valves 6 and 7;

a controller 20 configured to calculate a required flow rate of hydraulic fluid, which corresponds to the pressure detected by the pressure detection sensor Pa, Pb, Pc, Pd and output a control signal that corresponds to the calculated required flow rate; and an electronic proportional valve 22 configured to output, as a control signal, a secondary pressure generated therefrom to correspond to the control signal applied thereto from the controller, to a pump regulator 21 that controls a flow rate of the hydraulic fluid discharged from the hydraulic pump 2, the flow control method including:

a first step S10 of allowing the pressure detection sensor to detect the pilot pressure that is input to the first and second control valves 6 an 7 to shift the first and second control valves 6 and 7 through a manipulation of a manipulation lever;

a second step S20 of calculating the required flow rate of the hydraulic fluid, which corresponds to the detected manipulation amount of the manipulation lever using a relational expression between the manipulation amount and the required flow rate that is previously stored in the controller 20; and a third step S30 of outputting an electrical control signal that corresponds to the calculated required flow rate to the electronic proportional valve, wherein the flow rate of the hydraulic fluid supplied from the hydraulic pump 2 to the first and second hydraulic cylinders 3 and 4 by the shifting of the first and second control valves 6 and 7 is set to be equal to or lower than the flow rate of the hydraulic fluid passing through the pressure compensation type flow control valve 14 using the relational expression between the manipulation amount and the required flow rate. For this reason, in the case where the first hydraulic cylinder 3 or the second hydraulic cylinder 4 is driven alone, an excessive pressure can be prevented from being generated due to an increase in the flow rate of the hydraulic fluid discharged from the hydraulic pump 2.

According the configuration as described above, the spool of the first control valve 6 is shifted to the right on the drawing sheet by a pilot pressure input upon the manipulation of the manipulation lever in order to perform a single boom-down operation of the boom by the retractable drive of the first hydraulic cylinder 3. In this case, the pressure detection sensors Pa and Pb detect the pilot pressure that is input to the first control valve 6 to shift the first control valve 6 (see S10), and outputs a detection signal to the controller 20. The controller 20 calculates the required flow rate (Q1) of the hydraulic fluid relative to the manipulation amount of the manipulation lever to correspond to the detected pilot pressure using a relational expression between the manipulation amount and the required flow rate that is previously stored in the controller 20 (see S20). Then, when the controller 20 outputs a control signal corresponding to the calculated required flow rate of the hydraulic fluid to the electronic proportional valve 22 (see S30), the electronic proportional valve 22 outputs, a secondary pressure generated therefrom to correspond to the control signal input thereto output from the controller 20, to a pump regulator 21.

Thus, the hydraulic fluid discharged from the hydraulic pump 2 is reduced in the flow rate when passing through the first control valve 6 by the pressure compensation type flow control valve 14 installed in the meter-in flow path 12 of the first control valve 6. In other words, the hydraulic fluid from the hydraulic pump 2 whose flow rate is reduced by the pressure compensation type flow control valve 14 is supplied to the small chamber of the first hydraulic cylinder 3. At this point, the hydraulic fluid discharged from the large chamber of the first hydraulic cylinder 3 is returned to the hydraulic tank T via the return flow path 11 and the back pressure check valve 18.

In this case, when there is a shortage in the hydraulic fluid supplied to the small chamber during the retractable drive of the first hydraulic cylinder 3, the hydraulic fluid returned from the large chamber of the first hydraulic cylinder 3 to the hydraulic tank T is recycled and supplementarily supplied to the small of the first hydraulic cylinder 3 through the regeneration valve 13 of the regeneration flow path 10. For this reason, even in the case where the supply of the hydraulic fluid to the small chamber of the first hydraulic cylinder 3 is limited, a phenomenon can be prevented in which the hydraulic fluid is deficient in the small chamber of the first hydraulic cylinder 3 by the regeneration flow path 10 and the regeneration valve 13.

In the meantime, a spool of the second control valve 7 is shifted to the left or the right on the drawing sheet by the manipulation of the manipulation lever to simultaneously perform the boom-down and arm-out operations. In this case, the pressure detection sensors Pc and Pd detect the manipulation amount of the manipulation lever and output a detection signal to the controller 20. The controller 20 calculates the required flow rate of the hydraulic fluid, which corresponds to the detected manipulation amount of the manipulation lever using a relational expression between the manipulation amount and the required flow rate that is previously stored in the controller 20. Then, the controller 20 calculates the required flow rates of the hydraulic fluid of the first control valve 6 and the second control valve 7, respectively, and outputs a control signal corresponding to the calculated required flow rate of the hydraulic fluid to the pump regulator 21 through the electronic proportional valve 22.

In this case, when a combined operation of the first and second hydraulic cylinders 3 and 4 is performed, the flow rate of the hydraulic fluid required for the arm-out operation of the second hydraulic cylinder (i.e., the arm cylinder) 4 is higher than that of the hydraulic fluid required for the boom-down operation of the first hydraulic cylinder (i.e., the boom cylinder) 3, and thus the hydraulic pump 2 discharges a maximum amount of the hydraulic fluid. Thus, even in the case where the combined operation of the first and second hydraulic cylinders 3 and 4 is performed to cause the a large amount of the hydraulic fluid is discharged from the hydraulic pump 2, the supply of the hydraulic fluid from the hydraulic pump 2 to the small chamber of the first hydraulic cylinder 3 is limited by the pressure compensation type flow control valve 14 installed in the meter-in flow path 12 of the first control valve 6 (indicated by a line "b" in the graph of FIG. 7). On the other hand, the remaining hydraulic fluid discharged from the hydraulic pump 2 can be used to drive the second hydraulic cylinder 4 (indicated by a line "a" in the graph of FIG. 7).

As described above, in the case where a combined operation of the first and second hydraulic cylinders 3 and 4 is performed, a load pressure generated during the drive of the second hydraulic cylinder 4 (i.e., the arm-out operation) is relatively higher than that generated during the drive of the first hydraulic cylinder 3 (i.e., the boom-down operation). For this reason, the hydraulic fluid discharged from the hydraulic pump 2 can be prevented from being much more supplied to the first hydraulic cylinder 3 in whose load pressure is relatively low, thereby avoiding an unnecessary loss of the hydraulic fluid from the hydraulic pump 2.

INDUSTRIAL APPLICABILITY

In accordance with the flow control apparatus and method for a construction machine of the present invention as constructed above, the supply of the hydraulic fluid from the hydraulic pump to a boom cylinder whose load pressure is relatively low can be limited during a combined operation of a boom and an arm so that an unnecessary loss of the hydraulic fluid can be prevented, thereby improving the energy efficiency.

While the present invention has been described in connection with the specific embodiments illustrated in the drawings, they are merely illustrative, and the invention is not limited to these embodiments. It is to be understood that various equivalent modifications and variations of the embodiments can be made by a person having an ordinary skill in the art without departing from the spirit and scope of the present invention. Therefore, the true technical scope of the present invention should not be defined by the above-mentioned embodiments but should be defined by the appended claims and equivalents thereof.

The invention claimed is:

1. A flow control apparatus for a construction machine comprising:

an engine;

a variable displacement hydraulic pump connected to the engine;

a first hydraulic cylinder and a second hydraulic cylinder, which are connected to the hydraulic pump;

a first control valve installed in a center bypass path of the hydraulic pump, the first control valve being configured to allow hydraulic fluid discharged from the hydraulic pump to be returned to a hydraulic tank in its neutral state and configured to control a start, a stop, and a direction change of the first hydraulic cylinder in its shifted state;

a second control valve installed on a downstream side of the center bypass path of the hydraulic pump, the second control valve being configured to allow the hydraulic fluid discharged from the hydraulic pump to be returned to the hydraulic tank in its neutral state and configured to control a start, a stop, and a direction change of the second hydraulic cylinder in its shifted state;

a regeneration flow path configured to supplement and reuse the hydraulic fluid that returns to the hydraulic tank during a retractable drive of the first hydraulic cylinder, and a regeneration valve installed in the regeneration flow path; and a pressure compensation type flow control valve installed in a meter-in flow path of a spool of the first control valve and configured to limit the flow rate of the hydraulic fluid supplied from the hydraulic pump to the first hydraulic cylinder during a combined operation of the first and second hydraulic cylinders;

wherein the pressure compensation type flow control valve comprises a spool having a first position in which the meter-in flow path is opened by a pressure passing through a meter-in orifice installed in the meter-in flow path and an elastic force of a valve spring, and a second position in which the flow rate of the hydraulic fluid is limited through the shift of the spool in a direction in which an opening portion of the meter-in orifice is reduced if the pressure in the meter-in flow path is higher than the elastic force of the valve spring.

2. The flow control apparatus according to claim 1, wherein the first hydraulic cylinder is a boom cylinder, and the second hydraulic cylinder is an arm cylinder.

3. A flow control apparatus for a construction machine comprising:

an engine;

a variable displacement hydraulic pump connected to the engine;

a first hydraulic cylinder and a second hydraulic cylinder, which are connected to the hydraulic pump;

a first control valve installed in a center bypass path of the hydraulic pump, the first control valve being configured to allow hydraulic fluid discharged from the hydraulic pump to be returned to a hydraulic tank in its neutral state and configured to control a start, a stop, and a direction change of the first hydraulic cylinder in its shifted state;

a second control valve installed on a downstream side of the center bypass path of the hydraulic pump, the second control valve being configured to allow the hydraulic fluid discharged from the hydraulic pump to be returned to the hydraulic tank in its neutral state and configured to control a start, a stop, and a direction change of the second hydraulic cylinder in its shifted state;

a regeneration flow path configured to supplement and reuse the hydraulic fluid that returns to the hydraulic tank during a retractable drive of the first hydraulic cylinder, and a regeneration valve installed in the regeneration flow path;

a pressure compensation type flow control valve installed in a meter-in flow path of a spool of the first control valve and configured to limit the flow rate of the hydraulic fluid supplied from the hydraulic pump to the first hydraulic cylinder during a combined operation of the first and second hydraulic cylinders;

at least one pressure detection sensor configured to detect a pilot pressure that is input to the first and second control valves to shift the first and second control valves;

a controller configured to calculate a required flow rate of hydraulic fluid, which corresponds to the pressure detected by the pressure detection sensor and output a control signal that corresponds to the calculated required flow rate; and an electronic proportional valve configured to output, as a control signal, a secondary pressure generated therefrom to correspond to the control signal applied thereto from the controller, to a pump regulator that controls a flow rate of the hydraulic fluid discharged from the hydraulic pump;

wherein the spool is movable between a first position in which the meter-in flow path is opened by a pressure passing through a meter-in orifice installed in the meter-in flow path and an elastic force of a valve spring, and a second position in which the flow rate of the hydraulic fluid is limited through the shift of the spool in a direction in which an opening portion of the meter-in orifice is reduced if the pressure in the meter-in flow path is higher than the elastic force of the valve spring.

4. A flow control method for a construction machine including a variable displacement hydraulic pump connected to an engine, a first hydraulic cylinder and a second hydraulic cylinder, which are connected to the hydraulic pump, a first control valve installed in a center bypass path of the hydraulic pump and configured to control a start, a stop, and a direction change of the first hydraulic cylinder in its shifted state, a second control valve installed on a downstream side of the center bypass path of the hydraulic pump and configured to control a start, a stop, and a direction change of the second hydraulic cylinder in its shifted state, a regeneration flow path configured to reuse the hydraulic fluid that returns to a hydraulic tank by an attachment's own weight and a regeneration valve, a pressure compensation type flow control valve installed in a meter-in flow path of a spool of the first control valve and configured to limit the flow rate of the hydraulic fluid supplied from the hydraulic pump to the first hydraulic cylinder during a combined operation of the first and second hydraulic cylinders, at least one pressure detection sensor configured to detect a pilot pressure that is input to the first and second control valves to shift the first and second control valves, a controller configured to calculate a required flow rate of hydraulic fluid, which corresponds to the pressure detected by the pressure detection sensor and output a control signal that corresponds to the calculated required flow rate, and an electronic proportional valve configured to output, as a control signal, a secondary pressure generated therefrom to correspond to the control signal applied thereto from the controller, to a pump regulator that controls a flow rate of the hydraulic fluid discharged from the hydraulic pump, the flow control method comprising:

a first step of allowing the pressure detection sensor to detect the pilot pressure that is input to the first and second control valves to shift the first and second control valves through a manipulation of a manipulation lever;

a second step of calculating the required flow rate of the hydraulic fluid, which corresponds to the detected manipulation amount of the manipulation lever; and a third step of outputting an electrical control signal that corresponds to the calculated required flow rate to the electronic proportional valve, wherein the flow rate of the hydraulic fluid supplied from the hydraulic pump to the first and second hydraulic cylinders by the shifting of the first and second control valves is set to be equal to or lower than the flow rate of the hydraulic fluid passing through the pressure compensation type flow control valve; and wherein the spool is movable between a first position in which the meter-in flow path is opened by a pressure passing through a meter-in orifice installed in the meter-in flow path and an elastic force of a valve spring, and a second position in which the flow rate of the hydraulic fluid is limited through the shift of the spool in a direction in which an opening portion of the meter-in orifice is reduced if the pressure in the meter-in flow path is higher than the elastic force of the valve spring.

* * * * *